US006644875B1

(12) United States Patent
Sakaino et al.

(10) Patent No.: US 6,644,875 B1
(45) Date of Patent: Nov. 11, 2003

(54) PRINTING DEVICE

(75) Inventors: Tsuyoshi Sakaino, Tanashi (JP); Makoto Kawasaki, Tanashi (JP); Yoshiro Kato, Tanashi (JP); Katsuhiko Sato, Tanashi (JP)

(73) Assignee: Citizen Watch Company, Ltd., Tokyo (JP)

( * ) Notice: Subject to any disclaimer, the term of this patent is extended or adjusted under 35 U.S.C. 154(b) by 0 days.

(21) Appl. No.: 09/719,990

(22) PCT Filed: Apr. 17, 2000

(86) PCT No.: PCT/JP00/02488

§ 371 (c)(1),
(2), (4) Date: Dec. 19, 2000

(87) PCT Pub. No.: WO00/63098

PCT Pub. Date: Oct. 26, 2000

(30) Foreign Application Priority Data

Apr. 19, 1999 (JP) ..... 11-110384
Apr. 26, 1999 (JP) ..... 11-117422
Apr. 27, 1999 (JP) ..... 11-119570

(51) Int. Cl.[7] ..... B41J 11/42; B41J 11/48; B65H 7/02; B65H 9/00

(52) U.S. Cl. ..... 400/579; 400/582; 400/586; 400/596; 400/600; 400/630; 400/631; 400/625; 400/636; 400/637.3; 400/637.4; 271/227; 271/228; 271/236; 271/240; 271/242; 271/225; 271/243; 271/902

(58) Field of Search ..... 400/579, 582, 400/586, 596, 600, 630, 631, 625, 636, 637.3, 637.4; 271/227, 228, 236, 240, 242, 225, 902, 243

(56) References Cited

U.S. PATENT DOCUMENTS 4,473,222 A * 9/1984 Simmons et al. ..... 271/245
5,322,273 A * 6/1994 Rapkin et al. ..... 271/227
5,681,036 A * 10/1997 Wakahara et al. ..... 271/10.2
6,152,628 A * 11/2000 Satoh et al. ..... 400/579

FOREIGN PATENT DOCUMENTS

JP 63-178246 11/1988
JP 6-219588 8/1994
JP 2508855 6/1996

* cited by examiner

*Primary Examiner*—Andrew H. Hirshfeld
*Assistant Examiner*—Marvin P Crenshaw
(74) *Attorney, Agent, or Firm*—Smith, Gambrell & Russell, LLP

(57) ABSTRACT

Before stopper members (25) of a skew correcting mechanism (10) are evacuated from a sheet conveyor path, sheet conveyor roller pairs (8) rotate a set angle in a direction opposite to the sheet feeding direction such that a sheet is separated from the stopper members (25). The sheet conveyor roller pairs (8) are arranged so that at least one of the rollers of each pair is independently pressed against the other with a force corresponding to the type of the sheet.

20 Claims, 10 Drawing Sheets

PRINTING DEVICE

TECHNICAL FIELD

The present invention relates to a printing apparatus provided with a sheet conveyor mechanism, designed so that a sheet is held by means of conveyor roller pairs and delivered by means of frictional force, and a skew correcting mechanism for correcting a skew of the sheet fed skewed in the feeding direction.

BACKGROUND ART

Printing apparatuses frequently use sheet conveyor mechanisms, in which follower rollers are pressed against driving rollers so that a sheet is held between the driving rollers and the follower rollers as it is fed. The sheet conveyor mechanisms are designed to deliver the sheet by means of frictional force between the sheet and the rollers. The force for the delivery of the sheet is settled depending on the level of the force with which the follower rollers are pressed against the driving rollers.

According to one conventional printing apparatus, however, the type of sheets (standard sheets) to be normally used in the apparatus is supposed, and the level of the force of pressure contact is selected according to the sheet type. If a sheet that is thicker than standard ones is fed, the follower rollers are adapted to yield compressing shock absorbing springs. No special measures are taken to counter the use of sheets that are thinner than the standard ones.

On the other hand, many of the sheet conveyor mechanisms of the printing apparatuses are provided with stopper members for skew correction, which are located on the upper-stream side of a platen so that a skew of a sheet in the feeding direction can be adjusted by running the leading end edge of the sheet against them. This mechanism corrects the skew of the sheet by running the leading end edge of the sheet, skewed with slips between the rollers and the sheet, against the stopper members for skew correction and delivering the other side so that it runs against the stopper members with the delivery the impacted side (preceding side) stopped.

More specifically, the skew of the sheet is corrected by applying a turning moment to the sheet by means of sheet conveyor roller pairs. Primarily, however, a uniform holding force or uniform delivery force is applied to the sheet conveyor roller pairs so that the sheet can be delivered uniformly in the wide direction of the sheet. For skew correction, therefore, the holding force is adjusted so that greater slips are generated between the conveyor roller pairs and the sheet on the side where the sheet abuts against the stopper members for skew correction.

In a conventional sheet conveyor roller pair, however, one driving roller and one follower roller, which extend long in the width direction of a sheet conveyor path, are mounted on a driving shaft and a driven shaft, respectively, and the driving roller and the follower roller are opposed to each other. In consequence, the adjustment of the holding force is uniform in the width direction of the sheet, so that it is hard to obtain an appropriate holding force for adequate slips on one side and adequate feed on the other side. If the individual shafts are mounted so that they are situated at a distance of a value smaller than a set value from each other on one side and at a distance of a value greater than the set value on the other side, the sheet delivery force is greater on the shorter distance side. If the side on which the sheet delivery force is greater is coincident with the side to which adequate slips must be given, therefore, the slips are inadequate, so that there is a possibility of sheet jamming in positions for skew correction or of incomplete skew correction.

In order to correct a skew of a sheet, the sheet is expected to have a resistance high enough to stand the delivery force of the sheet conveyor roller pairs, which produce frictional force as they slide, without bending.

In the case of a sheet thinner than the standard ones or of a high-friction sheet, however, the delivery force of the sheet conveyor roller pairs is inevitably greater than the resistance of the sheet. In many cases, therefore, the sheet is bent or turned up during skew correction, so that the skew correction ends in failure. If the delivery force of the sheet conveyor roller pairs is reduced to fit the skew correction, in contrast with this, it is difficult normally to feed the sheet into a printing gap between the platen and a print head, since the resistance against the passage of the sheet in the printing gap is higher than in any other cases.

Disclosed in Japanese Utility Model Registration No. 2508855, therefore, is a printing apparatus in which soft auxiliary rollers 59 of sponge or the like are mounted individually on the respective outer peripheries of sheet feed rollers 51 (follower rollers) that are pressed against feed rollers 55 (driving rollers), as shown in FIG. 10. In this printing apparatus, a sheet is transported with the sheet delivery force of the sheet conveyor roller pairs reduced by means of the auxiliary rollers before stoppers for skew correction are reached. Thereafter, the sheet feed rollers 51 are pressed strongly against the feed rollers 55 to squeeze the auxiliary rollers 59 so that the sheet can be transported with a great delivery force. In FIG. 10, numeral 52 denotes an openable cover; 53, a shaft; 54, a shank; 56, a shaft; 57, a guide; 59, the auxiliary rollers; and 60, sheet stopper members.

However, this arrangement can only reduce the sheet feeding force before the skew correction and restore the normal feeding force after the skew correction, and cannot be a solution when the type of the sheet and therefore the thickness of the sheet are changed or when the frictional force between the sheet and the sheet conveyor roller pairs (coefficient of friction of the sheet surface) is changed.

Many sheet conveyor mechanisms of printing apparatuses are provided with a skew correcting mechanism, which is located on the upper-stream side of the platen in the sheet feeding direction and is designed so that a skew of a sheet in the feeding direction is corrected by running the leading end edge of the sheet against stopper members of the mechanism. The stopper members are arranged so that they project above a sheet conveyor surface to intercept the sheet conveyor path only during skew correction and are evacuated from the sheet conveyor surface so that they do not hinder the transportation of the sheet in other cases.

According to a conventional skew correcting mechanism (e.g., Japanese Utility Model Registration No. 2508855, mentioned above), however, the stopper members are evacuated with a sheet held against them after the sheet is run against the stopper members to correct the skew. Therefore, the evacuation of the stopper members is incomplete, so that the transportation of the sheet after the skew correction sometimes may be hindered. This is because the sheet held against the stopper members is strongly pressed by means of the feeding force of the sheet conveyor roller pairs for feeding even in that state, the friction between the leading end of the sheet and the stopper members is great, and movable parts of a mechanism for pushing the stopper members in the feeding direction to evacuate the stopper members are subject to pinching. This trouble is liable to occur when a particularly stiff sheet or thick sheet is used.

According to the conventional mechanism, therefore, the evacuation of the stopper members requires a substantial driving force or undue operation, so that the leading end edge of the sheet may be damaged, in some cases.

DISCLOSURE OF THE INVENTION

An object of the present invention is to provide a printing apparatus provided with a sheet conveyor mechanism, whereby skew correction and transportation of sheets into a printing gap can be normally performed even if the thickness and the coefficient of surface friction of the sheets varies depending on the type of the sheets. Another object is to provide a printing apparatus provided with a sheet conveyor mechanism, in which a sheet is given adequate slips on one side in the width direction thereof and adequate feed on the other side during skew correction so that a skew of the sheet can be corrected smoothly. Still another object is to provide a printing apparatus in which stopper members of a skew correcting mechanism can be easily evacuated without damaging the leading end edge of a sheet.

In order to achieve the above object, a first form of a printing apparatus according to the present invention comprises: a body frame; a sheet carrier fixed to the body frame and having a sheet conveyor surface defining a straight sheet conveyor path; a platen exposed to the sheet conveyor path through the sheet conveyor surface of the sheet carrier; a print head opposed to the platen; sheet conveyor rollers arranged on the upper-stream side of the platen in the sheet feeding direction, holding a sheet from both sides, obverse and reverse, and capable of transporting the sheet; a skew correcting mechanism including stopper members arranged between the platen and the conveyor rollers in the feeding direction and capable of projecting above the sheet conveyor path and receding from the sheet conveyor path; and a control device including a sheet sensor. The sheet conveyor rollers are adapted to rotate a set angle in a direction opposite to the sheet feeding direction such that the sheet is separated from the stopper members of the skew correcting mechanism before the stopper members are evacuated from a sheet conveyor path.

In the printing apparatus with this construction, the sheet conveyor roller pairs are reversed to separate the sheet from the stopper members before the stopper members are evacuated from the sheet conveyor path when the sheet correction is completed, so that the evacuation of the stopper members requires no substantial force. Further, there is no possibility of the leading end of the sheet conveyor mechanism being drawn in and damaged as the stopper members are evacuated or of sheet jamming.

Preferably, the stopper members of the skew correcting mechanism project above the sheet conveyor path in synchronism with a sheet detection signal from a paper-in sensor located in the sheet conveyor path on the upper-stream side of the sheet conveyor rollers.

Preferably, the stopper members of the skew correcting mechanism project above or recede from the sheet conveyor path by rotating around a rotating shaft located under the sheet carrier and extending parallel to the sheet feeding direction.

Preferably, the stopper members are in engagement with a driving plate capable of linear motion in a direction to cross the sheet conveyor path under the sheet carrier and rotate as the driving plate makes linear motion.

Preferably, the engagement of the stopper members and the driving plate is engagement between gear teeth of the stopper members equivalent to a pinion of a pinion-rack mechanism and a gear of the driving plate equivalent to a rack.

Preferably, the skew correcting mechanism includes a sub-frame and a solenoid for linear drive fixed to the sub-frame, the sub-frame having the stopper members rotatably supported thereon and the driving plate slidably attached thereto, and the driving plate is coupled with an armature of the solenoid to form one entire unit.

Preferably, the sheet conveyor rollers constitute a conveyor roller pair composed of a first roller and a second roller, a plurality of pairs are arranged in the width direction of the sheet in a manner such that at least the first or second roller is plural, and at least one of the rollers of each pair is independently pressed against the other with a predetermined force.

A second form of a printing apparatus according to the present invention comprises: a body frame; a sheet carrier fixed to the body frame and having a sheet conveyor surface defining a straight sheet conveyor path; a platen exposed to the sheet conveyor path through the sheet conveyor surface of the sheet carrier; a print head opposed to the platen; sheet conveyor roller pairs arranged on the upper-stream side of the platen in the sheet feeding direction, holding a sheet from both sides, obverse and reverse, and capable of transporting the sheet; and stopper members for skew correction arranged between the platen and the conveyor roller pairs in the feeding direction and capable of projecting above the sheet conveyor path and receding from the sheet conveyor path. The sheet conveyor roller pairs include a first roller and a second roller, a plurality of pairs are arranged in the width direction of the sheet in a manner such that at least the first or second roller is plural, and at least one of the rollers of each pair is independently pressed against the other with a predetermined force.

In the printing apparatus with this construction, a plurality of conveyor roller pairs are arranged so that the conveyor roller pairs independently have their respective sheet holding forces, so that the sheet can be smoothly rotated on the sheet conveyor surface during skew correction to correct the skew of the sheet in the feeding direction.

Preferably, the driving roller is supported on the sheet carrier, and the follower roller is pressed against the driving roller with a predetermined force.

Preferably, a plurality of follower rollers are rotatably supported on holders independently swingably supported on the body frame, and urging members for pressing the follower rollers to the driving rollers are arranged between the holders and the body frame.

Preferably, a plurality of the follower rollers are rotatably supported on holders independently swingably supported on the body frame, a movable member capable of position adjustment is arranged between the holders and the body frame, and urging members for pressing the follower rollers to the driving rollers are arranged between the holders and the movable member.

Preferably, the body frame supports a sub-frame for swinging motion such that the follower rollers can be brought into contact with or separated from the driving rollers by swinging the sub-frame, a plurality of follower rollers are rotatably supported on holders independently swingably supported on the sub-frame, and urging members for pressing the follower rollers to the driving rollers are arranged between the holders and the sub-frame.

Preferably, a swing shaft of the sub-frame is provided on the body frame in a manner such that the direction in which the follower rollers are brought into contact with or separated from the driving rollers is a tangential direction of the driving rollers parallel to the sheet feeding direction.

Preferably, the body frame supports a sub-frame for swinging motion such that the follower rollers can be brought into contact with or separated from the driving rollers by swinging the sub-frame, a plurality of the follower rollers are rotatably supported on holders independently swingably supported on the sub-frame, a movable member capable of position adjustment is arranged between the holders and the sub-frame, and urging members for pressing the follower rollers to the driving rollers are arranged between the holders and the movable member.

Preferably, a swing shaft of the sub-frame is provided on the body frame in a manner such that the direction in which the follower rollers are brought into contact with or separated from the driving rollers is a tangential direction of the driving rollers parallel to the sheet feeding direction.

Preferably, the urging members are provided individually for the holders.

Preferably, the force of the conveyor roller pairs to hold the sheet can be adjusted depending on the type of the sheet.

A third form of a printing apparatus according to the present invention comprises: a body frame; a sheet carrier fixed to the body frame and having a sheet conveyor surface defining a straight sheet conveyor path; a platen exposed to the sheet conveyor path through the sheet conveyor surface of the sheet carrier; a print head opposed to the platen; a plurality of sheet conveyor roller pairs arranged on the upper-stream side of the platen in the sheet feeding direction and capable of holding a sheet from both sides, obverse and reverse, with independent forces; a skew correcting mechanism including stopper members arranged between the platen and the conveyor roller pairs in the feeding direction and capable of projecting above the sheet conveyor path and receding from the sheet conveyor path; and a control device including a sheet sensor. The force of the sheet conveyor roller pairs to hold the sheet is adjustable depending on the type of the sheet.

BEST MODE FOR CARRYING OUT THE INVENTION

Figure 1:
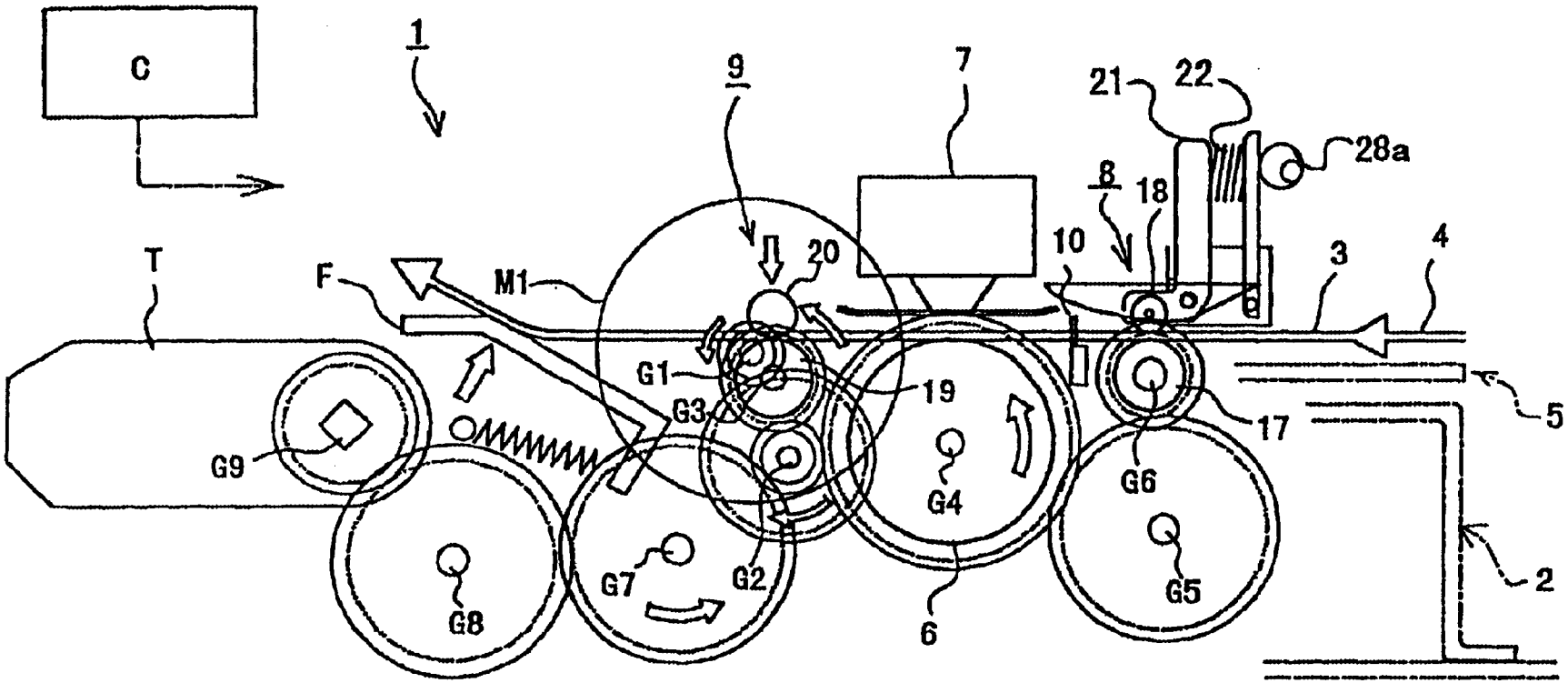
FIG. 1 is a view schematically illustrating a sheet conveyor mechanism of a printing apparatus according to the present invention.

An outline of a printer/conveyor mechanism of a printing apparatus according to the present invention will be described with reference to FIG. 1.

The printer/conveyor mechanism of the printing apparatus 1 includes a body frame 2, sheet carrier 5, platen 6, print head 7, first sheet conveyor roller pairs 8, second sheet conveyor roller pairs 9, and skew correcting mechanism 10.

A substantially flat sheet conveyor surface 4 is formed on a sheet conveyor path 3. The platen 6 is rotatably supported on the body frame 2 under the sheet conveyor path 3. The print head 7 is located opposite the top of the platen 6. A printing gap is defined between the print head 7 and the platen 6.

The body frame 2, which serves as a base on which various elements constituting the printing apparatus 1 are mounted, is formed by press-molding a steel plate. The sheet carrier 5, which is formed by press-molding a steel plate, is fixed to the body frame 2, thus forming the sheet conveyor path 3.

Symbol M1 designates a motor. Symbols G1 to G9 designate the respective axes of gears for power transmission, individually. The gears are provided individually on these axes and constitute a gearing for the motor M1. An idle gear is provided on the axis G2.

Each first sheet conveyor roller pair 8 is composed of a driving roller 17 and a follower roller 18, and is located on the upper-stream side of the platen 6 with respect to the sheet feeding direction. Each second sheet conveyor roller pair 9 is composed of a driving roller 19 and a follower roller 20, and is located on the lower-stream side of the platen 6. These driving rollers 17 and 19 are rotatably supported on the body frame 2 under the sheet conveyor surface 4, and are driven by means of the gearing that is actuated by the motor M1.

Symbol T designates a continuous sheet tractor. Symbol F designates a flapper, which serves to switch the sheet conveyor path 3 between modes for cut sheets and continuous sheet. FIG. 1 shows the mode for the use of cut sheets. Symbol C designates a control section that is included in the printing apparatus 1 and serves to drive various parts of the printing apparatus 1, time the operation, and process print signals and print data transmitted from a parent apparatus such as a so-called personal computer.

Figure 2:
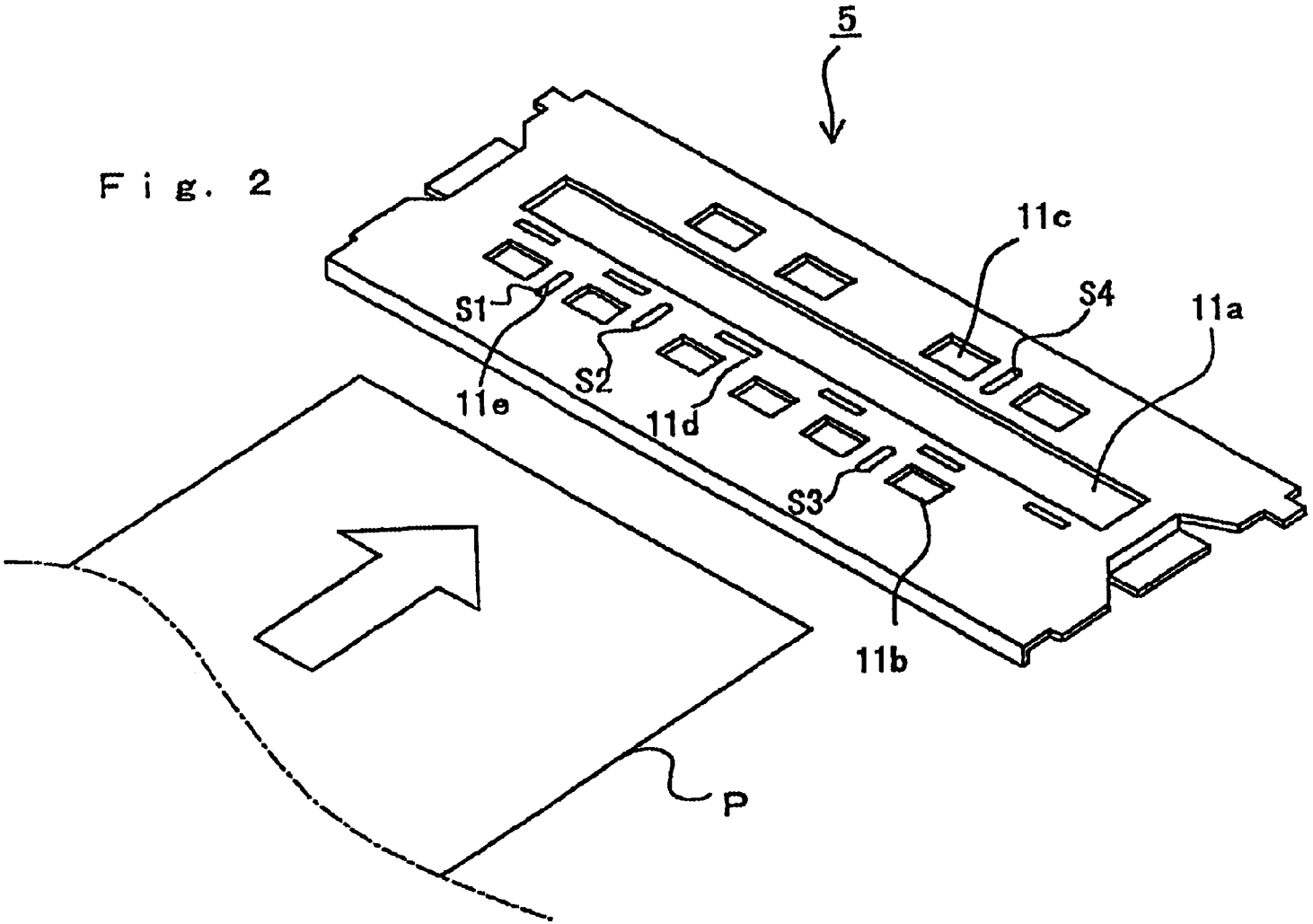
FIG. 2 is a perspective view of a sheet carrier of the sheet conveyor mechanism of FIG. 1.

The sheet carrier 5 will be described with reference to FIG. 2. FIG. 2 shows the upper surface of the sheet carrier.

The sheet carrier 5 is formed with one hole 11*a*, six holes 11*b*, four holes 11*c*, six holes 11*d*, and four holes 11*e*. A part of the platen 6 is exposed upward through the hole 11*a*. A part of the driving roller 17 (that constitutes the first sheet conveyor roller pair 8) is exposed upward through each hole 11*b*. A part of the follower roller (that constitutes the second sheet conveyor roller pair 9) is exposed upward through each hole 11*c*. A stopper portion 25 (mentioned later) of the skew correcting mechanism is exposed upward through each hole 11*d*. Sensors S1 to S4 for sheet position detection, which will be mentioned later, project upward from the four holes 11*e*, individually.

The sensors S1 to S4 for sheet position detection will be described with reference to FIG. 3.

The sensors S1 to S4 are rockably mounted on a horizontal shaft 12 that crosses the sheet conveyor path 3 under the sheet carrier 5. The sensors S1 and S4 have the same shape, and the sensors S2 and S3 have the same shape. Any of these sensors S1 to S4 is formed with an engaging claw 13 on one side of the horizontal shaft 12 and a balancer 14 on the other side. When no sheet is on the sheet carrier 5, the engaging claw 13 is caused to project upward from the hole 11*e* of the sheet carrier 5 by the weight of the balancer 14, as shown in FIGS. 3(*a*) and 3(*c*), and its posture is maintained. Further, a trigger 15 is formed integrally with the lower part of each of the sensors S1 to S4. Numeral 16 denotes a photocoupler, and symbol P designates a sheet.

The sensor S1 detects the leading end edge of the sheet that is fed on the sheet conveyor surface 4. The sensor S4 detects the trailing end edge of the cut sheet. As the cut sheet runs on the engaging claw 13, as shown in FIGS. 3(*a*) and 3(*b*), these sensors S1 to S4 rotate in the direction (direction indicated by arrow B in FIG. 3(*b*)) opposite to the sheet feeding direction (direction indicated by arrow A in FIG. 3) while causing a slip between the engaging claw 13 and the back of the sheet. When the passage of the sheet P is finished, the sensors S1 and S4 are returned to their original positions by the weight of the balancer 14.

The sensors S2 and S3 are somewhat staggered back and forth in the sheet feeding direction, and detect a skew of the sheet fed on the sheet conveyor surface 4. These sensors S2 and S3 are pushed to rotate in the feeding direction (in the direction of arrow C of FIG. 3(*b*)) as the leading end of the sheet abuts against their engaging claw 13, as shown in FIGS. 3(*c*) and 3(*d*). When the passage of the sheet P is finished, the sensors S1 and S4 are returned to their original positions by means of the balancer 14.

When the trigger 15 ceases to intercept light from the photocoupler 46 as the sensors S1 to S4 rock, a signal is delivered to the control section C.

As described above or seen from FIG. 3, the sensors S1 and S4 have the same shape, and the sensors S2 and S3 also have the same shape. However, the sensors S2 and S3 are arranged so that the respective mounting positions of the engaging claw 13 and the balancer 14 are reverse to those for the sensors S1 and S4.

As is schematically shown in FIG. 1, the follower roller 18 that constitutes the first sheet conveyor roller pair 8 is rotatably supported by means of a holder 21. The construction of the holder 21 will be described further in detail with reference to FIGS. 4 to 7.

Figure 4:
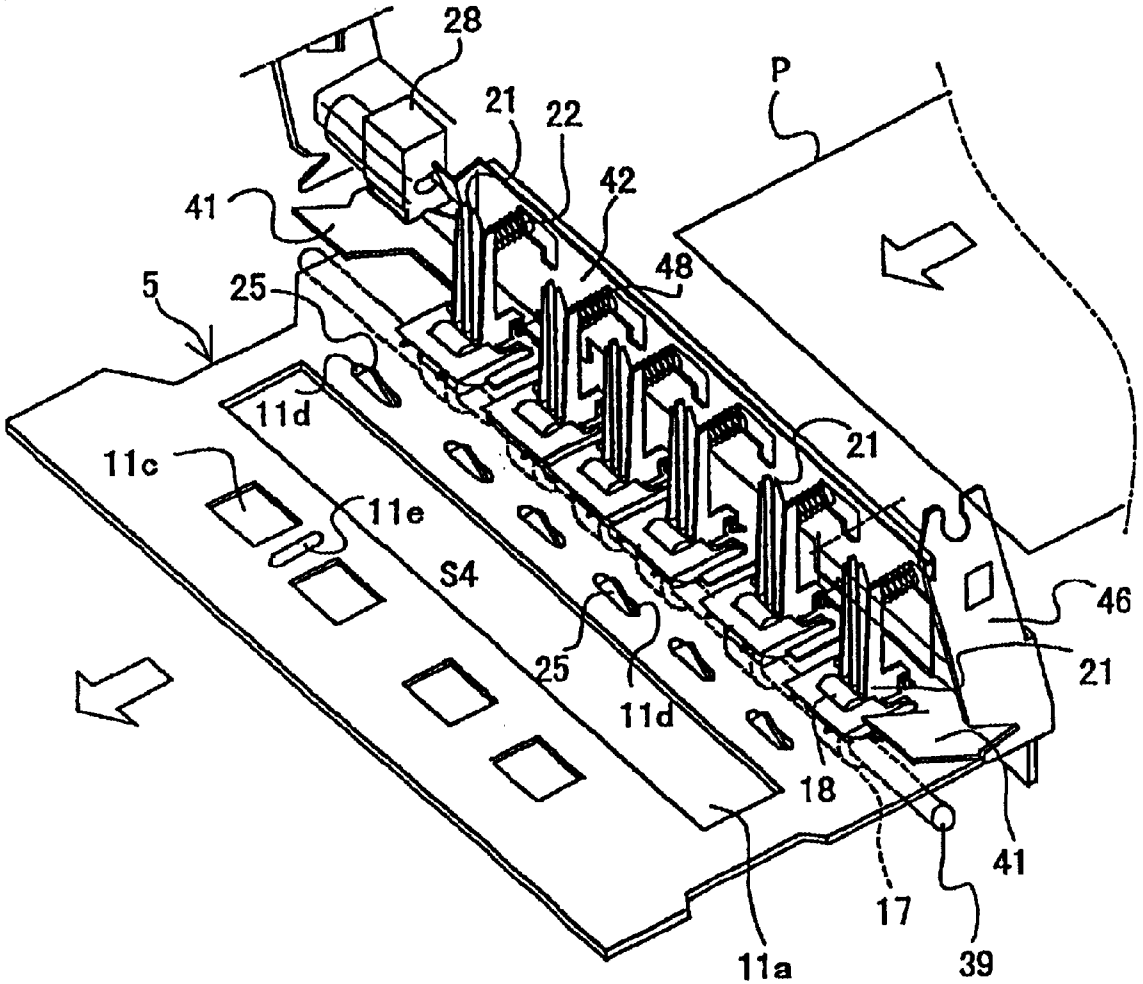
FIG. 4 is a perspective view for illustrating a skew correcting mechanism of the sheet conveyor mechanism of FIG. 1.

As shown in FIG. 4, six first sheet conveyor roller pairs 8 (driving rollers 17 and follower rollers 18) are arranged in a straight line in a direction such that they cross the sheet conveyor surface 4, so that six holders 21 of the same shape are used to support the follower rollers 18 for independent rotation. The holder 21, which is a molded piece of a synthetic resin, is formed of a horizontal portion 21*h* supporting the follower roller 18 for rotation and a vertical portion 21*v* of which the upper end portion is pressed by means of a coil spring 22.

The individual holders 21 are rotatably supported on a first sub-frame 41. When the upper end portion of the vertical portion 21*v* of each holder 21, rotatably supported on the first sub-frame 41, rocks around an axis X as it is pushed in the horizontal direction (direction E in FIG. 7) by means of the coil spring 22, the horizontal portion 21*h* (and follower roller 18) moves in the vertical direction (direction F in FIG. 7) toward the driving roller 17. Thus, the force with which the follower roller 18 is pressed against the driving roller 17 can be adjusted by rocking the holder 21 with respect to the first sub-frame 41 by means of the coil spring 22.

Figure 6:
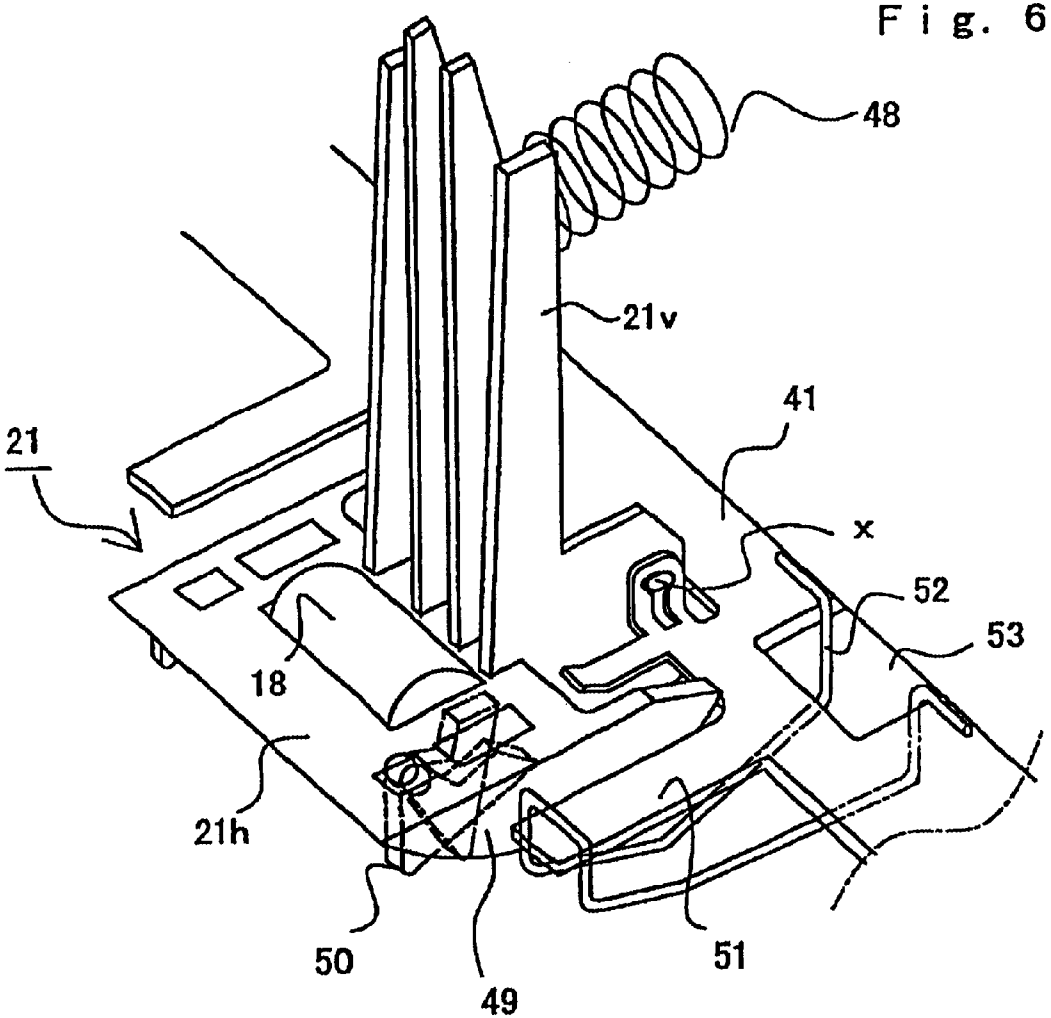
FIG. 6 is a perspective view of a holder for supporting a follower roller of a first sheet conveyor roller pair of FIG. 5.

As shown in FIG. 6, a sheet guide portion 49 having a curved lower surface is formed integrally with each of the opposite sides, left- and right-hand, of that part of the horizontal portion 21*h* which supports the follower roller 18 for rotation. The curved lower surface of the sheet guide portion 49 serves to prevent lifting of the sheet that passes under it. Further, the horizontal portion 21*h* supports a presser claw 50 for rocking motion such that it touches the sheet only when the sheet moves toward the printing gap, thereby preventing the sheet from lifting. When the presser claw 50 rocks toward the printing gap as the sheet moves, the lower end portion of the presser claw 50 projects on the side of the sheet conveyor surface 4 and is prevented from rocking further, but is allowed freely to rock in the opposite direction to recede from the sheet conveyor surface.

As shown in FIG. 6, moreover, a part of a presser bar spring 52 engages a projecting portion 51 of the first sub-frame 41 that projects adjacent to the horizontal portion 21*h* of the holder 21. The presser bar spring 52 is formed of a spring wire bent substantially in the shape of a V, and its bent portion catches on the distal end portion of the projecting portion 51 of the first sub-frame 41. Further, the opposite end portions (i.e., open-side portions) of the spring 52 catch individually on the opposite sides of an engaging hole 53 that is formed on that side of the first sub-frame 41 opposite from the side on which the projecting portion 51 is formed, whereby spreading force of the opposite end portions are restrained. Thus, the presser bar spring 52 is kept attached to the first sub-frame 41 in the manner shown in FIG. 5 by its own spring force, and its intermediate portion prevents the sheet from lifting.

One end of the coil spring 22 is fixed to the vertical portion 21*v* of the holder 21, while the other end thereof is fixed to a movable member 42, as shown in FIG. 4. The movable member 42 is situated inside a rear wall of the first sub-frame 41, and the respective lower parts of its left- and right-hand ends are swingably supported on the first sub-frame 41.

Figure 5:
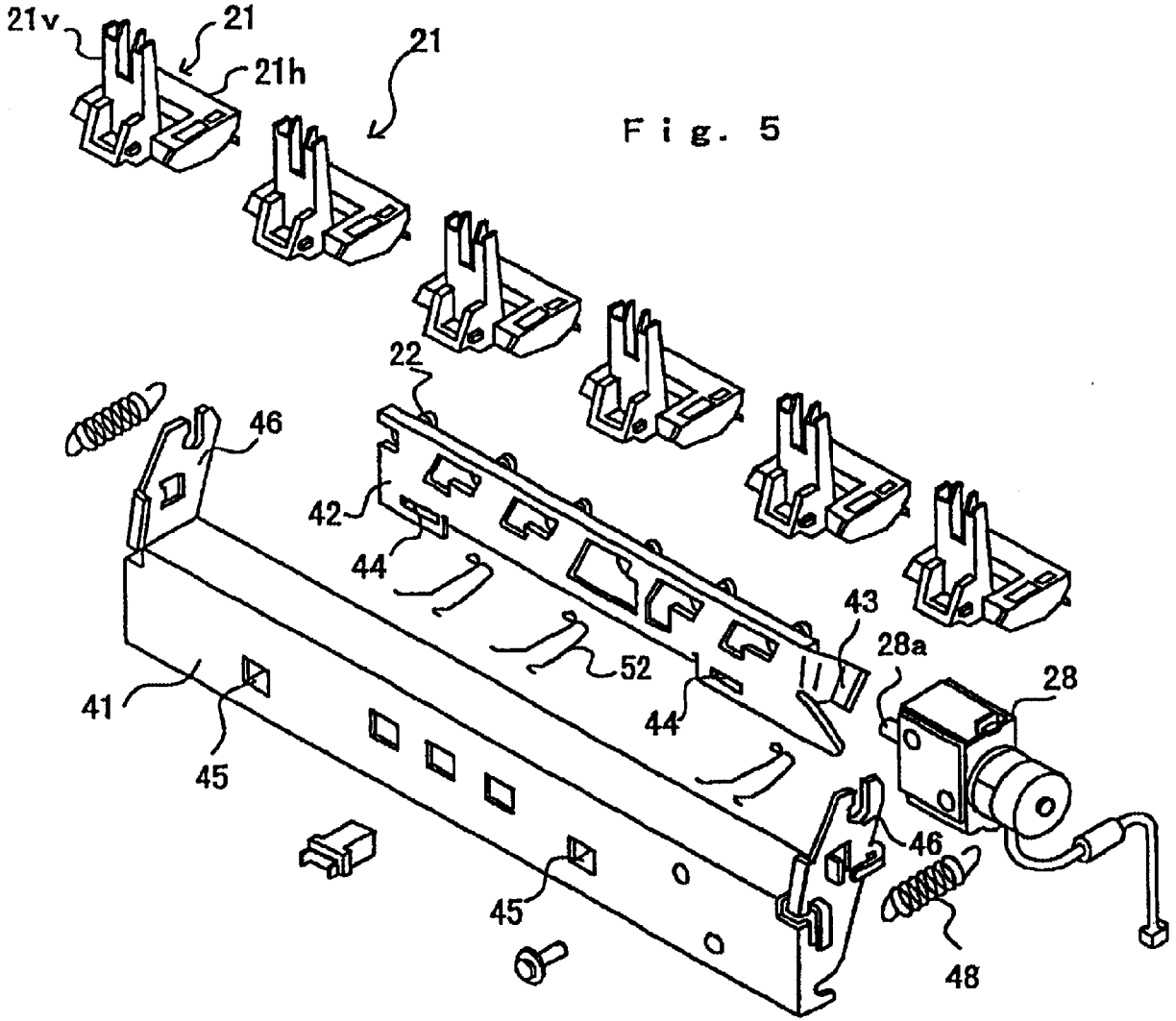
FIG. 5 is an exploded perspective view showing components related to first sheet conveyor roller pairs of the sheet conveyor mechanism of FIG. 1.

As shown in FIG. 5, the movable member 42 is a plate-like member that is formed by press-molding a steel plate and extends long from side to side, and a cam follower 43 in the shape of an oblique plate is molded integrally with one end of the movable member 42 in the longitudinal direction thereof. Two claw receiving holes 44, left and right, are formed in the lower side portion of the movable member 42. In positions corresponding individually to the six holders 21, moreover, six coil springs 22 are attached in a line to the upper side on of the movable member 42, as shown in FIG. 4.

Figure 7:
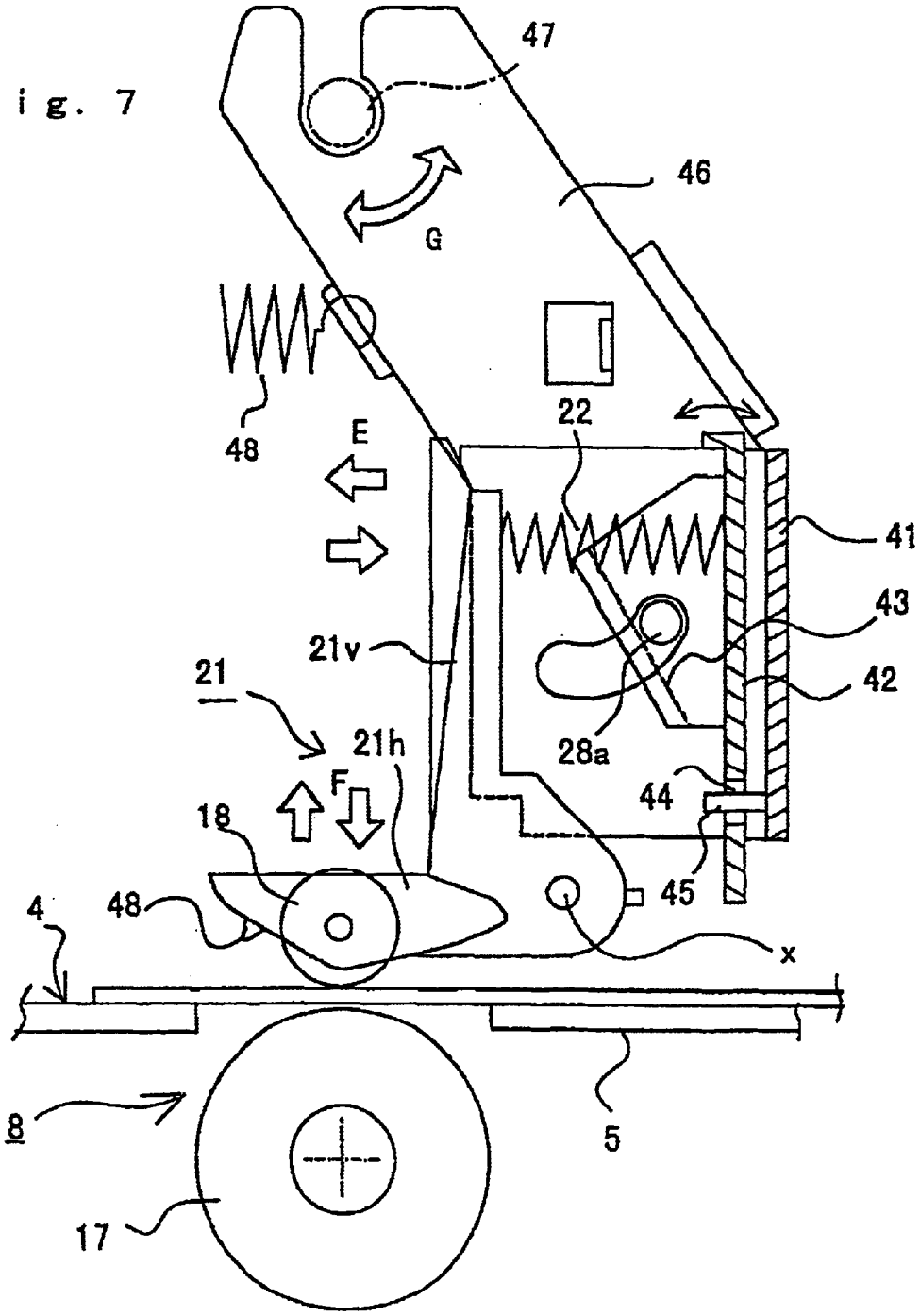
FIG. 7 is a view illustrating the operation of the holder of FIG. 6.

As described above, the first sub-frame 41 serves to combine the holders 21, movable member 42, coil springs 22, etc. so that the entire combined structure can swing relatively to the body frame 2. Two claws 45, left and right, are provided in the lower part of the rear wall of the first sub-frame 41, corresponding individually to the claw receiving holes 44 in the movable member 42. The claws 45 of the first sub-frame 41 are inserted individually into the claw receiving holes 44 of the movable member 42, as shown in FIG. 7.

Further, the first sub-frame 41 is provided with left- and right-hand engaging lugs 46 on its upper part. As its engaging lugs 46 engage protrusions 47 on the body frame 2, the first sub-frame 41 is attached to the body frame 2 for swinging motion around the protrusions 47 (in the direction indicated by arrow G in FIG. 7). Numeral 48 denotes a return spring, which serves to return the first sub-frame 41 to its original position.

The respective axes of the protrusions 47 and the axes of the driving rollers 17 are located on one straight line when the follower rollers 18 of the holders 21 supported on the first sub-frame 41 are pressed against the driving rollers 17 with the first sub-frame 41 in engagement with the protrusions 47 of the body frame 2. Thus, the swing axis of the first sub-frame 41 is set relatively to the body frame 2 so that the direction in which the follower rollers 18 move close to or away from the driving rollers 17 is perpendicular to the sheet moving direction in which the sheet held between the driving rollers 17 and the follower rollers 18 is fed.

As shown in FIG. 5, a stepping motor 28 is fixed to the inside of one end of the first sub-frame 41, corresponding to the cam follower 43 that is formed on the movable member 42. A disk having a pin 28*a* fixed thereon is attached eccentrically to the output shaft of the stepping motor 28. The pin 28*a* touches the cam follower 43 formed on the movable member 42. The cam follower 43 and the pin 28*a* constitute a cam mechanism, and this cam mechanism is driven by means of the stepping motor 28.

The follower roller 20 of each second sheet conveyor roller pair 9 can be adjusted in two stages or thereabout with respect to the driving roller 19, and is normally pressed with a substantially constant force of contact pressure. The force of pressure contact is produced by means of an urging member such as a spring that is located on a support portion between the body frame 2 and the follower roller 20.

The skew correcting mechanism will be described with reference to FIGS. 8 and 9.

The skew correcting mechanism 10 is composed of a second sub-frame 23, driving plate 24, stopper member 25, and solenoid 26. The second sub-frame 23 serves to combine the driving plate 24, stopper member 25, and solenoid 26 and form the entire combined structure as a unit. As the second sub-frame 23 is mounted on the body frame 2, the skew correcting mechanism 10 can be attached to the printing apparatus 1.

The second sub-frame 23 is a press-molded piece with an L-shaped cross section, which extends long in the direction to cross the sheet conveyor surface 4 and is composed of a vertical portion 23*v* and a horizontal portion 23*h*. The vertical portion 23*v* is formed with six shaft indicators 29 for the stopper members 25 that are arranged at equal spaces. Further, arcuate guide notches 30 are formed in the vertical portion 23*v* on the opposite sides of each shaft indicator 29, individually. The shaft support portion 29 is formed by burring during pressing operation and offers a rotating shaft that extends parallel to the sheet feeding direction and serves for the rotation of the stopper member 25. Further, a plurality of guide pieces 31 are formed on the lower part of the second sub-frame 23 by raising so that they are arranged at given spaces in the longitudinal direction of the second sub-frame.

Figure 8:
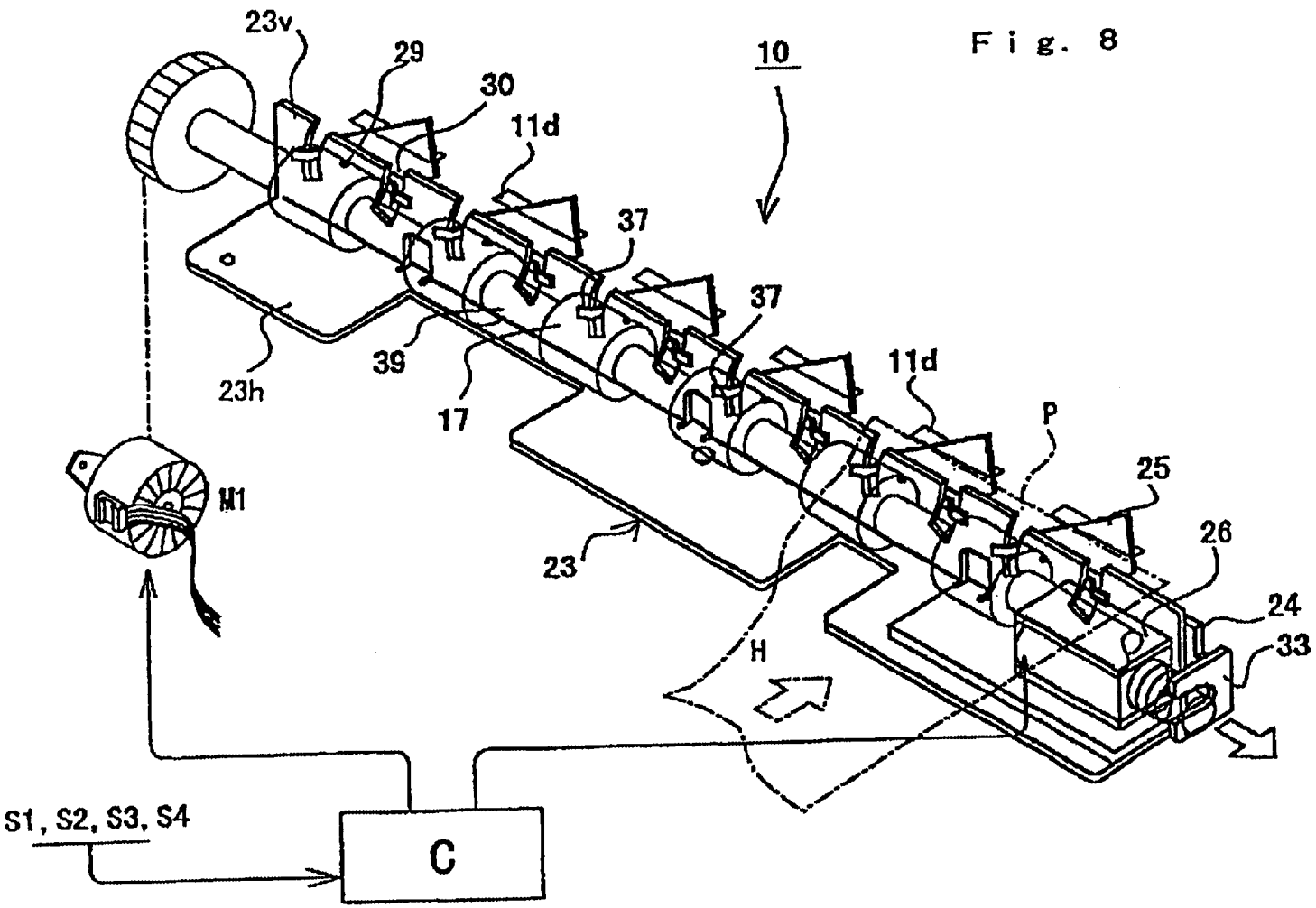
FIG. 8 is a perspective view of the skew correcting mechanism of FIG. 1.
Figure 9:
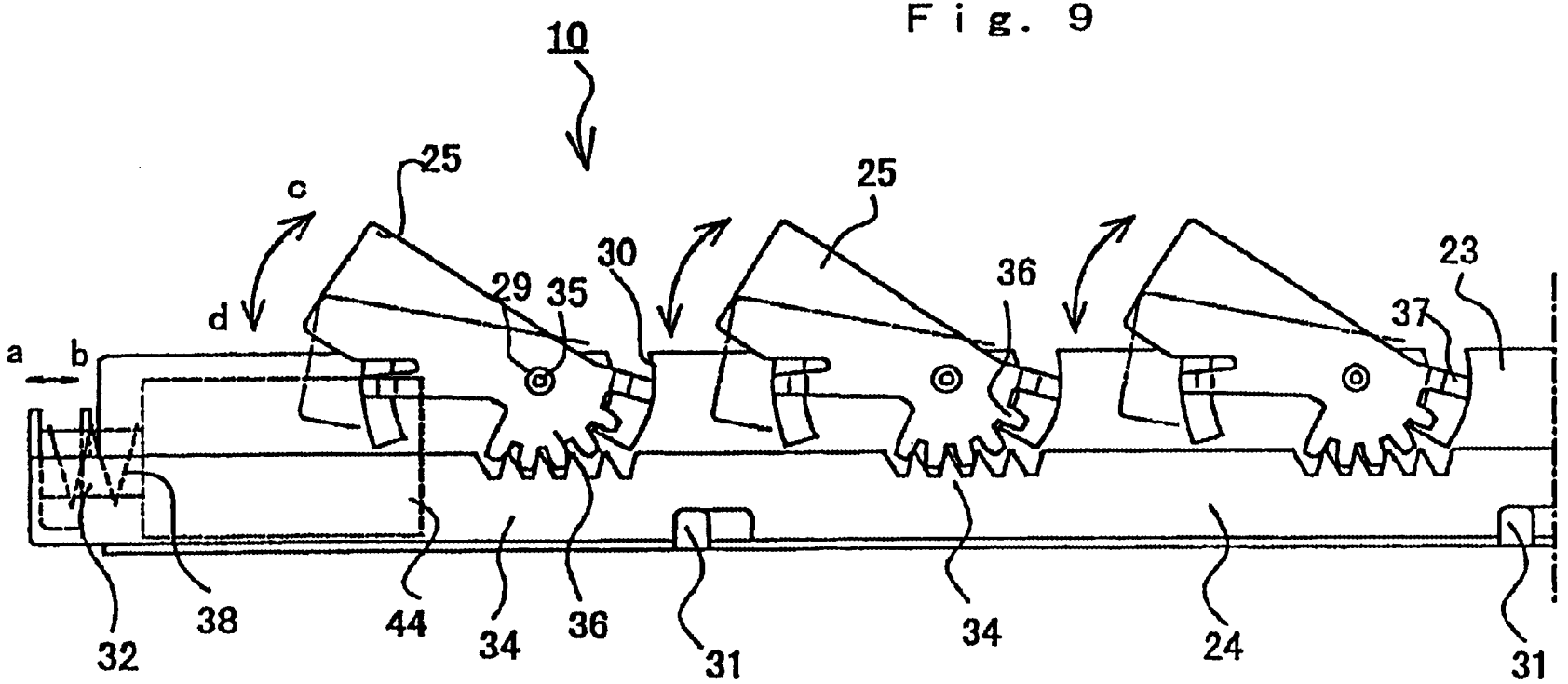
FIG. 9 is a view illustrating the operation of stopper members used in the skew correcting mechanism of FIG. 8.
Figure 10:
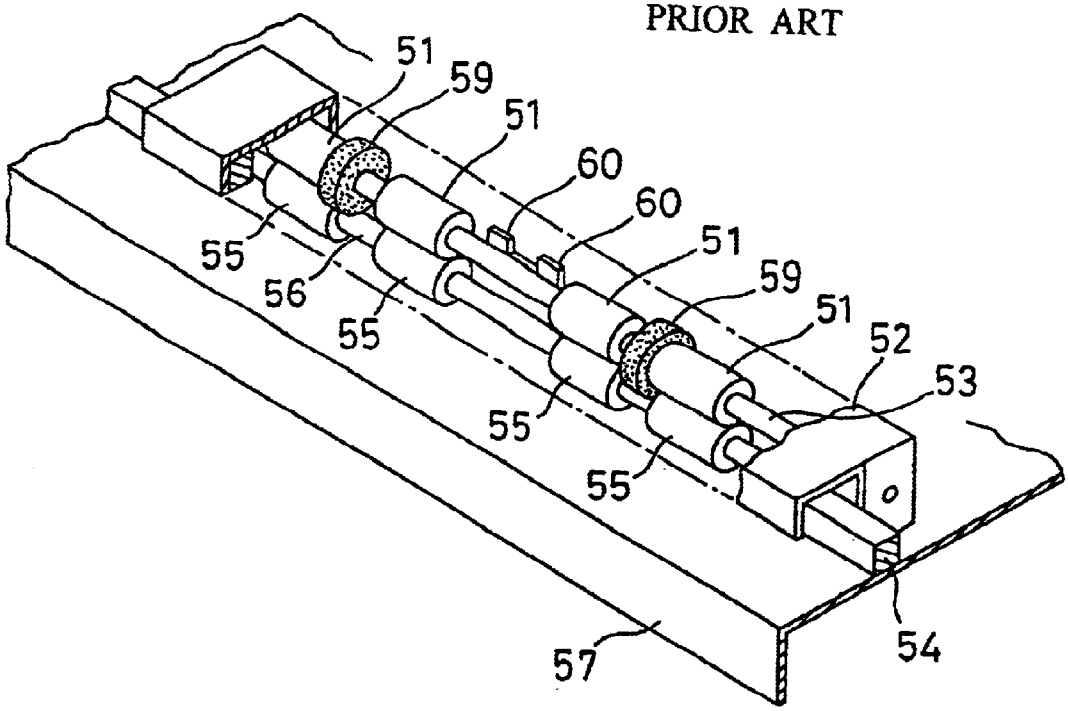
Fig.10 PRIOR ART
FIG. 10 shows a prior art example of a printing apparatus provided with a skew correcting mechanism.

The driving plate 24 is situated on the lower part of the front face (on the lower-stream side in the sheet feeding direction indicated by arrow H in FIG. 8) of the vertical portion 23*v* of the second sub-frame 23. The driving plate 24 can get on the guide pieces 31 of the second sub-frame 23 and, guided by the guide pieces 31, slide in the longitudinal direction of the vertical portion 23*v*.

One end of the driving plate 24 is bent rearward at substantially right angles, and forms a mounting portion 33 that can be coupled to an armature 32 of the solenoid 26, as shown in FIG. 8. The driving plate 24 is a member that is equivalent to a rack of a pinion-rack mechanism. Six partial straight arrays of gear teeth (rack teeth) 34 are formed spaced on the upper side of the driving plate 24, corresponding in position to the respective shaft support portions 29 of the stopper members 25, individually.

The stopper members 25 are substantially rectangular members, the respective distal end portions of which project above the sheet conveyor surface 4 through the holes 11*d* (FIGS. 2 and 4) of the sheet carrier 5 or recede from the holes 11*d*, individually. The proximal end portion of each stopper member 25 is formed with a pivot hole 35, gear teeth (pinion teeth) 36 formed on the outer periphery covering about 90° around the pivot hole 35, and a pair of guide claws 37. The guide claws 37 are formed individually on the opposite sides of the proximal end portion of the stopper member 25. These paired guide claws 37 are constructed so that they can get out to the rear face side of the vertical portion 23*v* (upper-stream side in the sheet feeding direction) through the guide notches 30, individually, formed on the opposite sides of the shaft support portion 29 of each vertical portion 23*v* of the second sub-frame 23.

In front of the vertical portion 23*v* of the second sub-frame 23, the driving plate 24 is caused to engage the guide pieces 31 of the second sub-frame 23 so that the driving plate 24 can slide relatively to the second sub-frame 23. Then, each stopper member 25 is mounted in a manner such that the pivot hole 35 in the proximal end portion of the stopper member 25 is fitted on the shaft support portion 29 of the vertical portion 23*v* of the second sub-frame 23, and the guide claws 37 on the opposite sides of the proximal end portion of the stopper member 25 are caused to engage the guide notches 30 of the vertical portion 23*v* of the second sub-frame 23. Thus, the stopper member 25 can be rotatably attached to the vertical portion 23*v* of the second sub-frame 23 without the possibility of slipping off even though the shaft support portion 29 of the vertical portion 23*v* of the second sub-frame 23 is not provided with any special measure against slippage. At the same time, the pinion teeth 36 on the proximal end portion of the stopper member 25 engage the rack teeth 34 of the driving plate The solenoid 26 is fixed to one end side of the horizontal portion 23*h* of the second sub-frame 23. The distal end of the armature 32 of the solenoid 26 is coupled to the mounting portion 33 of the driving plate 24. The solenoid 26, which is of a single-motion type, draws in the armature 32 when energized and is returned to its original position by means of a spring 38 when de-energized. More specifically, the driving plate 24 moves in the direction of arrow b of FIG. 9 when it is energized. Thereupon, all the stopper members 25 rotate together in the direction of arrow d of FIG. 9, so that the stopper members 25 are evacuated from the sheet conveyor surface 4. When they are de-energized, the stopper members 25 rotate together in the direction of arrow c of FIG. 9, so that the respective distal ends of the stopper members 25 project above the sheet conveyor surface 4 through the holes 11*d* of the sheet carrier 5.

The six driving rollers 17 that constitute the first sheet conveyor roller pairs 8 are mounted on one drive shaft 39, as shown in FIGS. 4 and 8. The drive shaft 39 is driven by means of the gearing that is actuated by the motor M1. Further, the motor M1 and the solenoid 26 are under the control of the control section C, and the forward and reverse rotations of the motor M1 and current supply to the solenoid are timed in association with one another according to system programs that are stored in a storage section of the control section C.

The following is a description of the operation of the printing apparatus 1 that is controlled by means of the control section C.

The sheet P is set in the printing apparatus 1, and the type and thickness of the sheet are taught to the control section C by means of a sheet selection button (not shown) that is attached to the printing apparatus 1. Thereupon, the control section C reads information corresponding to the selected sheet P from the data storage section (not shown), and causes the stepping motor 28 to rotate an angle corresponding to the data.

As the stepping motor 28 rotates, the pin 28*a* presses the cam follower 43 formed on the movable member 42 as it rocks, thereby adjusting the angle of the movable member 42 relative to the body frame 2, as shown in FIG. 7. More specifically, the degree of compressive deformation of the coil springs 22 interposed between the movable member 42 and the holders 21 is adjusted, whereby the force with which the follower rollers 18 that are attached to the respective horizontal portions 21*h* of the holders 21 press the driving rollers 17 can be adjusted to a value that fits the selected sheet P. Data with which the stepping motor 28 is driven by a necessary angle corresponding to the type and thickness of the sheet are previously obtained by conducting experiments on resistance and friction for the feed of each sheet and stored in the data storage section of the control section C.

When the printing apparatus 1 is operated so that a print signal from the personal computer or parent apparatus, the first sheet conveyor roller pairs 8 rotate forward to feed the sheet P onto the sheet conveyor surface 4. At this point of time, the solenoid 26 is energized, and the stopper members 25 are evacuated from the sheet conveyor surface 4.

Figure 3:
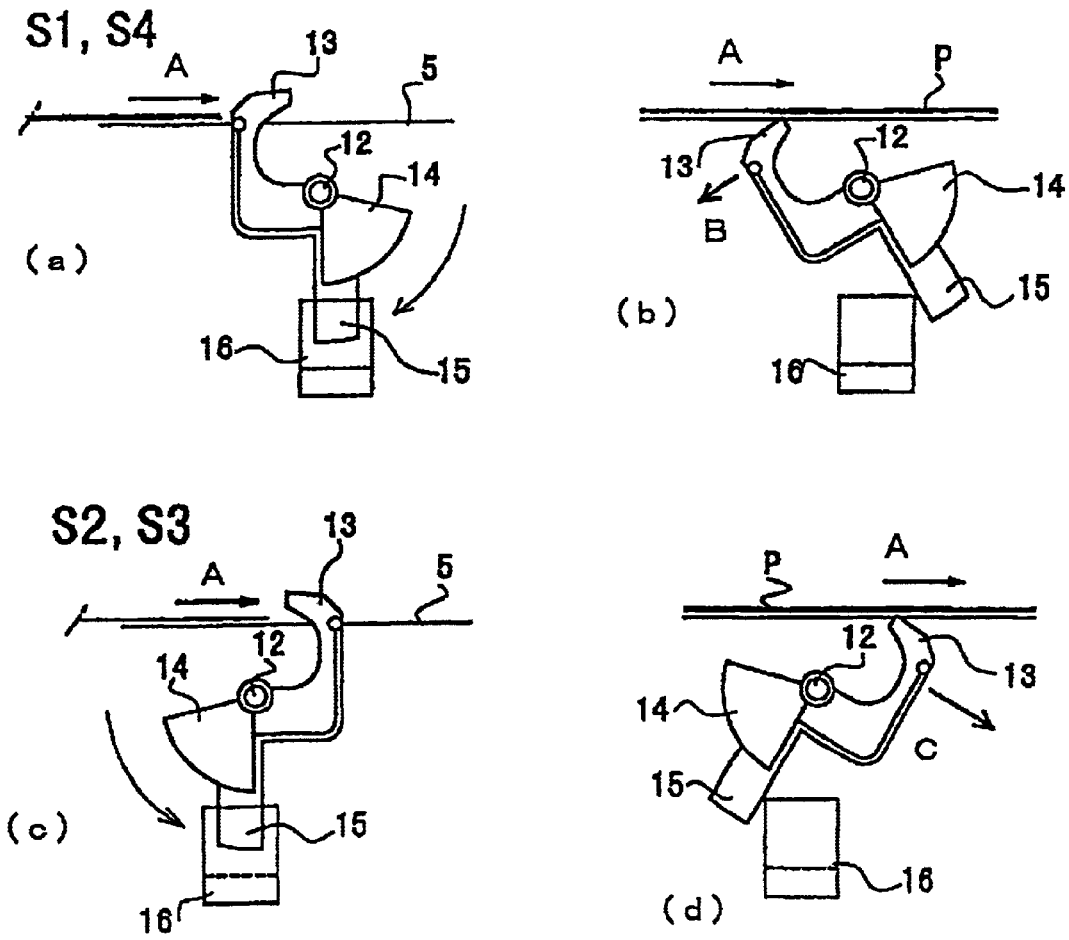
FIG. 3 is a view illustrating the constructions and operations of sensors set in holes formed in the sheet carrier.

When the leading end edge of the sheet P passes the sensor S1 (paper-in sensor), the sensor S1 rotates in the direction indicated by arrow B in FIG. 3(*b*), so that the trigger 15 is disengaged from the photocoupler 16. In consequence, an on-signal is transmitted to the control section C. In response to this on-signal, the control section C cuts off the solenoid 26 from current supply, and causes the respective distal end portions of the stopper members 25 to project above the sheet conveyor surface 4. The first sheet conveyor roller pairs 8 continue to rotate forward.

The sheet P further moves in the feeding direction, the leading end edge of the sheet causes the sensors S2 and S3 to rotate, and on-signals from the sensors S2 and S3 are transmitted to the control section C. If the transmission of the on-signals from the sensors S2 and S3 is subject to a time difference that is found to be greater or smaller than a preset time difference, it is concluded that the leading end edge of the sheet is skewed. Thereupon, the leading end edge of the sheet is run against the stopper members 25 in a manner such that the stopper members 25 projecting above the sheet conveyor surface 4 are kept as they are (i.e., not evacuated), whereby the skew of the sheet P is corrected.

While only the preceding side of the leading end edge of the sheet fed skewed in either direction is abutting against the stopper members 25, the sheet goes on being fed as it is. As it is prevented from advancing by the stopper members 25, the preceding side of the sheet causes a slip between the sheet and the sheet conveyor roller pairs 8, while the substantial feed of the sheet is continued on the other side. The skew of the sheet is corrected in this manner.

If the control section C concludes that the sheet is skewed, it actuates a timer. After the passage of a given period of time, the control section C concludes that the skew correction is completed. Then, it reverses the motor M1, causes the sheet conveyor roller pairs 8 to rotate reversely, separate the sheet P from the stopper members 25. As this is done, the solenoid 26 is energized, and the stopper members 25 are evacuated from the sheet conveyor surface 4. This given period of time is the time interval that elapses from the instant that it is concluded that the sheet is skewed until the skew of the sheet is actually corrected, and is set with reference to the results of past measurements. This period of time, which varies depending on the type, thickness, etc. of the sheet, is adjusted to one second or thereabout. The sheet conveyor roller pairs 8 are reversely rotated for a short time, which is shorter than a period for one revolution of each driving roller 17. If current supply to the solenoid 26 is confirmed, the control section C causes the sheet conveyor roller pairs 8 to rotate forward, thereby feeding the sheet P into the printing gap.

If the leading end edge of the sheet is skewed in the feeding direction to a degree such that it requires skew correction, as described above, the preceding side of the skewed leading end edge of the sheet first runs against the stopper members 25 for skew correction. Of the six first sheet conveyor roller pairs 8, those located on the side (preceding side) where movement is prevented by collision continue to rotate with a greater slip with respect to the sheet, so that the skew of the sheet can be corrected properly. These six sheet conveyor roller pairs 8 have their functions to hold the sheet independently of one another and can never be influenced by the states of rotation of their adjacent roller pairs 8. Although the respective forces of the sheet conveyor roller pairs 8 to hold the sheet are made uniform, therefore, appropriate slips can be independently produced between the sheet and the conveyor roller pairs 8 to effect the skew correction. In consequence, greater slips can be smoothly generated on the side where the sheet abuts against the stopper members 25 as regards the width direction of the sheet. Consequently, adequate slips and feed can be given to the sheet on one and the other sides, respectively, with respect to the width direction of the sheet, so that a turning moment for skew correction can be appropriately given to the sheet. Thus, there is no possibility of sheet jamming in positions for skew correction or of incomplete skew correction.

As mentioned before, moreover, the force of pressure with which the follower roller 18 is pressed against the driving roller 17 is properly selected by previously rocking the output shaft of the stepping motor 28 by the angle corresponding to the currently used sheet, thereby causing the movable member 42 to swing a given angle. Accordingly, there is no possibility of the sheet being bent if the sheet conveyor roller pairs 8 slide on the sheet as they give a feeding force to the sheet.

After the skew correction, the sheet is fed out into the printing gap with the selected holding force.

Furthermore, the sheet that is fed into the printing gap by means of the first sheet conveyor roller pairs 8 is prevented from lifting by means of the sheet guide portion 49 and the presser bar spring 52 (FIG. 6) that are attached to the horizontal portion 21*h* of each holder 21. Thus, there is no possibility of the sensor failing to detect the leading end of the sheet or the presence of the sheet due to the lifting of the sheet or of wrong skew adjustment.

If the time difference, if any, in the transmission of the on-signals from the sensors S2 and S3 is within a predetermined range, on the other hand, it is concluded that the sheet is not skewed, the control section C keeps the solenoid 26 energized, and the sheet conveyor roller pairs 8 maintain the forward rotation and feed the sheet P directly into the printing gap (between the print head 7 and the platen 6) without making skew correction.

Then, printing is carried out in the printing gap in the conventional manner, and line feed is executed by means of the second sheet conveyor rollers 9. If a print end signal or page change signal is given, the control section C causes the second sheet conveyor roller pairs 9 to deliver the sheet P. When the sheet P passes the sensor S4, the control section C stops the rotation of the second sheet conveyor rollers 9 in response to a signal from the sensor S4, whereupon printing operation for the one sheet P terminates.

The following is a description of modifications of the embodiment described above.

According to the foregoing embodiment, the stopper members 25 used are six in number. However, the stopper members 25 are expected only to be arranged in the direction to cross the sheet conveyor surface 4 and be able to project and recede, and may be two in number. Alternatively, one stopper member that is long in the transverse direction may be used with the same result. The drive source for causing the stopper members 25 to project above or recede from the sheet conveyor surface is not limited to the solenoid 26, and may be constructed so as to convert the rotation of the motor into a linear motion by means of a cam or the like.

The rotation of the sheet conveyor roller pairs 8 may be reversed also by switching the idle gear in the gearing.

The above-described skew correcting mechanism is in the form of a unit using the second sub-frame 23. In some cases, however, the stopper members 25, driving plate 24, and solenoid 26 may be attached directly to the body frame 2 from which the vertical portion 23*v* is cut and raised.

The holders 6 and the movable member 42 may be attached directly to the body frame 2 without using the first sub-frame 41.

An ordinary motor or servomotor, not the stepping motor 28, may be used for the rocking motion of the movable member 42, which is made in order to adjust the force with which the follower rollers 18 that constitute the first sheet conveyor roller pairs 8 are pressed against the driving rollers 17. Further, the body frame 2 may be formed with graduations through which the extent of rocking motion of the movable member 42 can be visually checked so that an operator can watch the graduations as s/he manually rocks the movable member 42. Further, the movable member 42 may be translated instead of being rocked.

The means for applying the force with which the follower rollers 18 are pressed against the driving rollers 17 may be a spring of any other form than the coil spring 22 or any other urging means.

What is claimed is:

1. A printing apparatus comprising:

a body frame;

a sheet carrier fixed to the body frame and having a sheet conveyor surface defining a straight sheet conveyor path;

a platen exposed to the sheet conveyor path through the sheet conveyor surface of the sheet carrier;

a print head opposed to the platen;

sheet conveyor rollers arranged on the upper-stream side of the platen in the sheet feeding direction, holding a sheet from both sides, obverse and reverse, and capable of transporting the sheet;

a skew correcting mechanism including stopper members arranged between the platen and said conveyor rollers in the feeding direction and capable of projecting above the sheet conveyor path and receding from the sheet conveyor path; and a control device including a sheet sensor, said sheet conveyor rollers being adapted to rotate a set angle in a direction opposite to the sheet feeding direction such that the sheet is separated from the stopper members of the skew correcting mechanism before the stopper members are evacuated from a sheet conveyor path.

2. A printing apparatus according to claim 1, wherein said stopper members of said skew correcting mechanism project above the sheet conveyor path in synchronism with a sheet detection signal from a paper-in sensor located in the sheet conveyor path on the upper-stream side of said sheet conveyor rollers.

3. A printing apparatus according to claim 2, wherein said stopper members of said skew correcting mechanism project above or recede from the sheet conveyor path by rotating around a rotating shaft located under said sheet carrier and extending parallel to the sheet feeding direction.

4. A printing apparatus according to claim 3, wherein said stopper members are in engagement with a driving plate capable of linear motion in a direction to cross the sheet conveyor path under the sheet carrier and rotate as said driving plate makes linear motion.

5. A printing apparatus according to claim 4, wherein the engagement of said stopper members and said driving plate is an engagement between gear teeth of the stopper members equivalent to a pinion of a pinion-rack mechanism and a gear of the driving plate equivalent to a rack of the pinion-rack mechanism.

6. A printing apparatus according to claim 4, wherein said skew correcting mechanism includes a sub-frame and a solenoid for linear drive fixed to the sub-frame, the stopper members being rotatably supported on the sub-frame and the driving plate being slidably attached to the sub-frame, and the driving plate is coupled with an armature of the solenoid to form one entire unit.

7. A printing apparatus according to claim 1, wherein said sheet conveyor rollers constitute a conveyor roller pair composed of a first roller and a second roller, a plurality of pairs are arranged in the width direction of the sheet in a manner such that at least one of the first roller and the second roller is plural in number, and at least one of the rollers of each pair is independently pressed against the other with a predetermined force.

8. A printing apparatus according to claim 7, wherein said first and second rollers are a driving roller and a follower roller, respectively.

9. A printing apparatus according to claim 7, wherein the force of said conveyor roller pairs to hold the sheet can be adjusted depending on the type of the sheet.

10. A printing apparatus comprising:

a body frame;

a sheet carrier fixed to the body frame and having a sheet conveyor surface defining a straight sheet conveyor path;

a platen exposed to the sheet conveyor path through the sheet conveyor surface of the sheet carrier;

a print head opposed to the platen;

sheet conveyor roller pairs arranged on the upper-stream side of the platen in the sheet feeding direction, holding a sheet from both sides, obverse and reverse, and capable of transporting the sheet; and stopper members for skew correction arranged between the platen and said conveyor roller pairs in the feeding direction and capable of projecting above the sheet conveyor path and receding from the sheet conveyor path, said sheet conveyor roller pairs including a first roller and a second roller, a plurality of pairs being arranged in the width direction of the sheet in a manner such that at least the first or second roller is plural in number, at least one of the rollers of each pair being independently pressed against the other with a predetermined force such that each roller pair holds the sheet independently of the other roller pairs and is not influenced by states of rotation of adjacent roller pairs.

11. A printing apparatus according to claim 10, wherein said first and second rollers constituting said sheet conveyor roller pair are a driving roller and a follower roller, respectively.

12. A printing apparatus according to claim 11, wherein said driving roller is supported on said sheet carrier, and said follower roller is pressed against the driving roller with a predetermined force.

13. A printing apparatus according to claim 12, wherein a plurality of said follower rollers are rotatably supported on holders independently swingably supported on the body frame, respectively, and which further comprises urging members arranged between the holders and the body frame and pressing the follower rollers to said driving rollers.

14. A printing apparatus according to claim 12, wherein a plurality of said follower rollers are rotatably supported on holders independently swingably supported on the body frame, and which further comprises a movable member arranged between the holders and the body frame and capable of position adjustment and urging members arranged between the holders and the movable member and pressing the follower rollers to said driving rollers.

15. A printing apparatus according to claim 12, wherein said body frame supports a sub-frame for swinging motion such that said follower rollers can be brought into contact with or separated from the driving rollers by swinging the sub-frame, and a plurality of said follower rollers are rotatably supported on holders independently swingably supported on the sub-frame, and which further comprises urging members arranged between the holders and the sub-frame and pressing the follower rollers to said driving rollers.

16. A printing apparatus according to claim 15, wherein a swing shaft of said sub-frame is provided on the body frame in a manner such that the direction in which the follower rollers are brought into contact with or separated from the driving rollers is a tangential direction of the driving rollers parallel to the sheet feeding direction.

17. A printing apparatus according to claim 12, wherein said body frame supports a sub-frame for swinging motion such that said follower rollers can be brought into contact with or separated from the driving rollers by swinging the sub-frame, and a plurality of said follower rollers are rotatably supported on holders independently swingably supported on the sub-frame, and which further comprises a movable member arranged between the holders and the sub-frame and capable of position adjustment and urging members arranged between the holder and the movable member and pressing the follower rollers to said driving rollers.

18. A printing apparatus according to claim 17, wherein a swing shaft of said sub-frame is provided on the body frame in a manner such that the direction in which the follower rollers are brought into contact with or separated from the driving rollers is a tangential direction of the driving rollers parallel to the sheet feeding direction.

19. A printing apparatus according to claim 17, wherein said urging members are provided individually for the holders.

20. A printing apparatus comprising:

a body frame;

a sheet carrier fixed to the body frame and having a sheet conveyor surface defining a straight sheet conveyor path;

a platen exposed to the sheet conveyor path through the sheet conveyor surface of the sheet carrier;

a print head opposed to the platen;

a plurality of sheet conveyor roller pairs arranged on the upper-stream side of the platen in the sheet feeding direction and capable of holding a sheet from both sides, obverse and reverse, with independent forces;

a skew correcting mechanism including stopper members arranged between the platen and said conveyor roller pairs in the feeding direction and capable of projecting above the sheet conveyor path and receding from the sheet conveyor path; and a control device including a sheet sensor, the force of said sheet conveyor roller pairs to hold the sheet being adjustable depending on the type of the sheet.

* * * * *